United States Patent [19]

Longhouse

[11] 4,329,946

[45] May 18, 1982

[54] SHROUD ARRANGEMENT FOR ENGINE COOLING FAN

[75] Inventor: Richard E. Longhouse, Dayton, Ohio

[73] Assignee: General Motors Corporation, Detroit, Mich.

[21] Appl. No.: 128,675

[22] Filed: Mar. 10, 1980

Related U.S. Application Data

[63] Continuation-in-part of Ser. No. 82,697, Oct. 9, 1979, abandoned.

[51] Int. Cl.[3] ..... F01P 7/10

[52] U.S. Cl. ..... 123/41.49; 415/DIG. 1; 165/51

[58] Field of Search ..... 123/41.49, 195 C; 165/51, 122; 415/DIG. 1, 182, 207; 416/169 A

[56] References Cited

U.S. PATENT DOCUMENTS

| | | | |
|---|---|---|---|
| 2,186,837 | 1/1940 | McMahan | 123/41.49 |
| 3,237,614 | 3/1966 | Bentz | 123/41.49 |
| 3,621,822 | 11/1971 | Oster | 123/41.49 |
| 3,842,902 | 10/1974 | Poslusny | 123/41.49 |
| 3,937,192 | 2/1976 | Longhouse | 123/41.49 |
| 4,116,269 | 9/1978 | Ikeda | 123/41.49 |
| 4,181,172 | 1/1980 | Longhouse | 123/41.49 |

*Primary Examiner*—Craig R. Feinberg
*Assistant Examiner*—W. R. Wolfe
*Attorney, Agent, or Firm*—Charles R. White

[57] ABSTRACT

A bladed fan has an inlet shroud formed with a bell-mouthed inlet section which extends to an annular skirt portion affixed to the tips of the blades of the fan. The fan and the shroud are immersed within a shroud fixed to an engine cooling radiator. This fixed shroud has an ejector section that extends to or beyond the rotating shroud and fan blading. The bell-mouthed inlet section has sufficient arc to prevent separation so that the fan operates at high efficiency and discharges air outwardly therefrom including the blockage of the clearance between the two shrouds to thereby effectively reduce air recirculation.

7 Claims, 6 Drawing Figures

SHROUD ARRANGEMENT FOR ENGINE COOLING FAN

This is a continuation-in-part of application Ser. No. 082,697 filed Oct. 9, 1979 now abandoned.

This invention relates to engine cooling fans and, more particularly, to a multibladed cooling fan having new and improved relatively rotatable shrouding to retard the recirculation of air into a specially contoured fan inlet provided by a rotatable shroud to improve fan efficiency and to reduce fan-generated noises.

Prior to the present invention, various shrouding designs have been devised for automotive engine cooling fans to reduce fan-generated noise and to make the fan pump air with higher efficiency. Among these are shroud assemblies that are fixed with respect to the engine heat-dissipating radiator which have cylindrical ejectors within which the fan is immersed. However, with higher standards new and improved shrouding arrangements are required. In my prior U.S. Pat. No. 3,937,192 issued Feb. 10, 1976 for Ejector Fan Shroud Arrangement, a rotating shroud is attached to the tips of the fan blades, and immersed within the fixed shroud having a flared extension to provide a passage therebetween for the improved flow of the peripheral air from the inlet or suction side of the fan to the exhaust or pressure side. In that construction, the rotating shroud is provided with a diffuser that improves the mixing of fan-pumped air and entrained air being discharged between the two shrouds. While this prior construction provides an improvement over fixed shroud designs insofar as efficiency and noise control are concerned, undesired quantities of air pumped by the fan are recirculated through the passage between the rotating and fixed shrouds back into the inlet of the rotating shroud. Furthermore, when turning the leading edge or inlet of the rotating shroud, the inner layers of the recirculating air became detached from the inner wall of the rotating shroud. With this detachment, there was a transition from laminar to turbulent flow. With turbulent air entering the fan, the fan blades and, in particular, the outer radial portion thereof which received most of the turbulence, could not efficiently handle the recirculating air so that fan pumping efficiency was adversely affected and fan noise was generated.

In the present invention, new and improved fixed and rotating fan shroud construction is provided with cooperative action to achieve new levels of fan efficiency and fan noise reduction. The rotating shroud is formed with a bell-mouthed inlet of sufficient curvature to eliminate or sharply reduce recirculating air separation to accordingly reduce turbulence. Importantly, in this invention, the rotatable shroud cooperates with an ejector portion of the fixed shroud so that radial components of the air pumped by the fan effectively block or further restrict the passage between the two shrouds. With the passage between the shrouds reduced, the amount of recirculating air entering the rotating shroud is markedly reduced to improve fan efficiency, since less air is repumped by the fan.

In one embodiment of the invention, the fixed shroud has a cylindrical non-flaring ejector portion generally concentric with the bladed fan and the rotating shroud. This ejector shroud extends a fixed distance beyond the terminal edges of the fan blades and the rotating shroud fixed to the tips thereof. The radial component of the high velocity air discharged by the powered fan may impinge onto the inner wall of the fixed shroud to pneumatically restrict the clearance between the fixed and rotating shrouds so that the recirculating flow of air from the high pressure or exhaust side of the fan to the low pressure or inlet side thereof is sharply reduced in volume. With such reduced recirculating flow, fan efficiency is sharply improved. The air which is recirculated turns the corner of the bell-mouthed inlet of the rotating shroud without separation from the inner wall of the bell-mouthed inlet. Without separation, turbulence of the inflow air into the fan is reduced. With reduced and smoother laminar flow entering the fan blades, the fan can pump the air at reduced noise levels and with higher efficiency to minimize parasitic effect of the fan on fuel consumption.

In a second embodiment of the invention, a double radiused inlet section of the rotating shroud provides for smooth laminar flow into the fan blading supporting this shroud.

In another embodiment of the invention, the fixed shroud is formed with an axially extending but shortened ejector which is substantially concentric with the outlet end of the rotatable shroud. The terminal ends of the fixed and rotating shrouds are generally coplaner but with variation occuring in accordance with allowable production tolerances and variations in the fan and shroud mountings. In this embodiment of the invention, some radial components of the discharged air will restrict the opening between the fixed and rotating shroud so that the quantity of recirculating air is reduced. While the pneumatic blockage of this embodiment of the invention is not as efficient as that of the first mentioned embodiment, clearance between these two shrouds is preferably held to a practical minimum for quantity production so that the recirculating air passage is substantially equivalent in restriction as the first embodiment.

Accordingly, it is a feature, object and advantage of this invention to provide new and improved rotating and fixed shrouding for multibladed fans in which the rotating shroud is immersed within a fixed ejector shroud secured to a radiator and has a bell-mouthed inlet curved to match the flow of recirculating air entering the suction side of the fan so that air separation and resultant turbulence is sharply minimized.

Another feature, object and advantage of this invention is to provide new and improved fan construction with relatively rotatable shrouding in which the radial component of discharged air effectively reduces the clearance between the relatively rotating shrouds to thereby reduce amounts of air recirculating from the pressure to the suction side of the fan.

Another feature, object and advantage of this invention is to provide new and improved rotating and fixed shrouding for an engine cooling fan in which the rotating shroud, fixed to the tips of the fan blades, is immersed within a surrounding fixed shroud which has an ejector portion, the extremity of which terminates in the same general plane of the extremity of the rotating shroud.

Another feature, object and advantage of this invention is to provide new and improved relatively rotating shrouding for a fan in which the clearance between the fixed and rotating shrouds is preferably kept to an optimized minimum. With reduced clearance, the radial component of discharge air is effective to block passage between the fixed and rotating shrouds so that recirculating airflow is restricted. The reduced recirculating airflow is smoothly fed by the bell-mouthed construction of the rotating shroud into the bladed fan without turbulence so that there is increased efficiency and reduced fan generated noises.

These and other features, objects and advantages of this invention will be more apparent from the following detailed description and drawing, in which.

Figure 1:
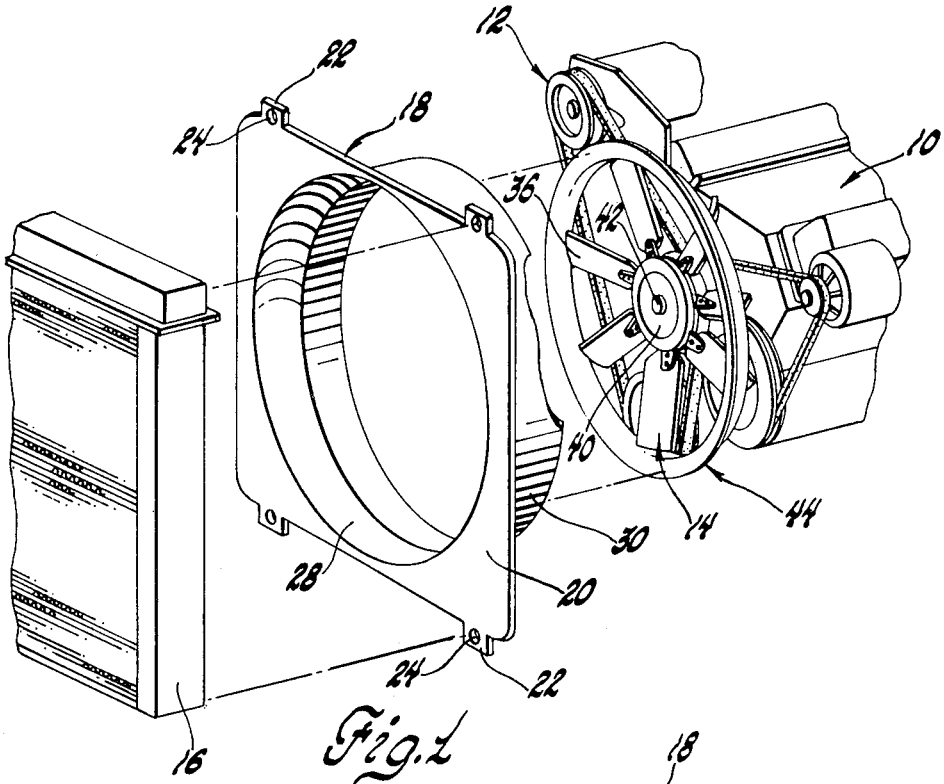
FIG. 1 is an exploded perspective view of an automotive radiator, engine and engine cooling fan and a fan shrouding arrangement illustrating a first embodiment of this invention.

Referring now to the drawing in greater detail, FIG. 1 illustrates an automotive internal combustion engine 10 powering a belt and pulley drive system 12 operatively mounted on the front end thereof for driving accessories including a bladed cooling fan 14. A radiator 16 hydraulically connected to the vehicle engine dissipates engine generated heat as engine coolant is circulated therethrough. The radiator 16 is mounted separately from the engine immediately in front of the cooling fan 14 and supports a thin-walled outer shroud 18 of plastic material or sheet metal. The outer shroud is a fixed or stationary shroud having a generally rectangular shaped base 20 with a plurality of spaced tabs 22 extending outwardly from the periphery and adjacent to the corners thereof. Tabs 22 are formed with openings 24 for receiving threaded fasteners 26 used to secure the outer shroud 18 to the radiator.

In addition to the rectangular base portion 20, the outer shroud 18 includes an annular and convexly curved intermediate extension 28 and a cylindrical ejector 30 projecting inwardly from the extension 28 and terminating in an annular edge 32 downstream of the trailing edges of the blades 36 of the fan.

As shown, the blades 36 are arcuately spaced from one another and extend radially outwardly from the hub portion of a fan pulley 40 rotatably mounted on a projecting shaft 42 supported by engine 10. As will be appreciated, the blades 36 are pitched to pump a flow of cooling air through the radiator for engine cooling purposes when the fan pulley 40 is driven by the engine through the belt and pulley system 12.

Attached to the outer extremity of the radial fan blades 36 is an annular thin-walled shroud 44 which cooperates with the outer shroud to provide an increase in fan pumping efficiency while allowing the fan to operate at a low noise level. The shroud 44 is a rotating shroud having an annular bell-mouthed inlet section 46 disposed forwardly and radially outwardly of the leading edges of the fan blades 36. This outwardly flaring inlet section has a smooth inner surface and preferably describes an arc of about 90 degrees or more and terminates in an annular outwardly extending edge 47. With this radial edge, recirculating air represented by flow arrow A flowing from the pressure to the suction side of the fan, can enter the bell-mouthed section without separation from the inner walls of this section. The recirculating air is subsequently funneled in a laminar flow pattern by the inner walls of the bell mouth into the rotating blades of the fan. Since air turbulence is avoided or sharply minimized in the recirculating air, the fan can pump air supplied thereto with high efficiency and with reduced noise levels.

The bell-mouthed inlet section 46 of the rotating shroud 44 is housed within the larger diameter intermediate portion 28 of the fixed outer shroud 18 to provide sufficient clearance between these relatively rotating shroud sections. This also allows for the reduction in clearance between the ejector portion 30 of the outer shroud and the rotating shroud illustrated as clearance "C" in FIG. 3. The annular clearance "C" between the concentric extending portions of the fixed and rotating shrouds is preferably held to a minimum to reduce recirculating airflow from the pressure exhaust side of the fan. However, this clearance must be sufficiently large to accommodate engine oscillations relative to the fixed shroud and size and mounting variations occurring in quantity production.

Figure 2:
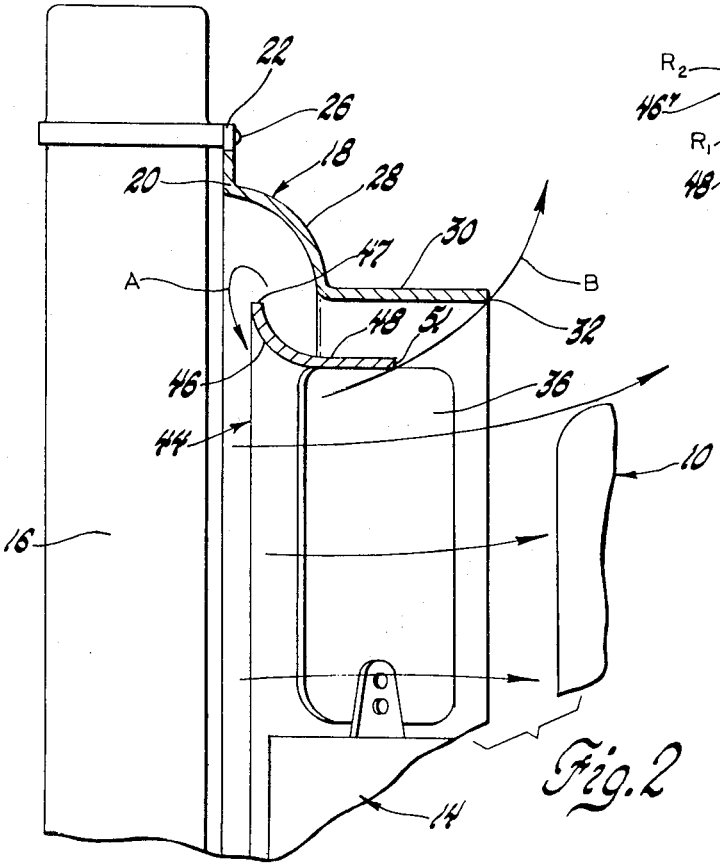
FIG. 2 is a fragmentary cross-sectional view of a portion of the fan and shroud of FIG. 1.

As shown best by FIG. 2, the skirt portion 48 of the rotating shroud extends inwardly from the bell-mouthed inlet section and is secured to the tips of the fan blades. The annular skirt portion 48 terminates in an annular end edge 51 within the confines of the larger diameter ejector 30. The distance "I" that edge 51 of the rotating shroud is located from the trailing edge 32 of the fixed shroud represents the amount of axial immersion of the rotating shroud into the fixed shroud.

With an immersion of 3.18 mm, a clearance of 5.56 mm has been found to be acceptable. However, smaller and larger clearances may be effectively employed when appropriately matched with immersion depths. Thus, if clearance "C" is larger than 5.56 mm, the amount of immersion "I" should be accordingly increased to provide for high-efficiency, low-noise fan operation. If the clearance between the shroud is reduced from 5.56 mm, the amount of shroud immersion should be accordingly reduced for the improved fan performance.

With the bell-mouthed inlet section 46 outwardly flared through an arc of about 90 degrees or more and with the outwardly extending annular edge 47, a flow control construction is provided that corresponds with inlet curving laminar flow of recirculating air illustrated in FIG. 2 by flow arrow "A." With this match, there is little or no separation of the inner layers of air from the walls of the rotating shroud so that inlet induced turbulence is held to a minimum. With a smooth flow of air entering the rotatably driven fan blades, the fan can pump air at a low noise level and with high efficiency.

With the rotatable fan shrouding appropriately immersed within the stationary shrouding, the discharged air pumped by the fan will have a radial component which is directed onto the inner wall of the fixed shroud. This portion of the discharged air partially blocks the clearance "C" and consequently inhibits the recirculation of air from the discharge side of the fan through clearance "C" back into the suction side of the fan and, in particular, into the bell-mouthed section of the rotating shroud. This blockage or restriction is illustrated in FIG. 2 by flow arrow "B" which extends between the terminal edges of the fixed and rotating shrouds.

Accordingly, the rotating shroud provides an inlet section in which airflow separation is minimized. Furthermore, with the rotating shroud immersed within the fixed shroud an appropriate distance, the fan and rotating shroud effectively provide a discharge which cooperates with the fixed shroud which, in effect, further reduces the clearance "C" so that the quantity of recirculating air is held to a minimum. With the amount of recirculating air minimized by the shrouding and with the 90° bell-mouthed inlet, pumping efficiency of a fan is increased and the fan blading operates at a low noise level.

Figure 3:
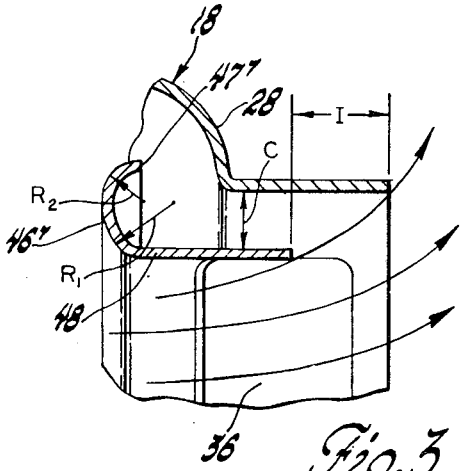
FIG. 3 is a fragmentary cross-sectional view similar to the view of FIG. 1 illustrating a second embodiment of this invention.

FIG. 3 is similar to the construction of FIG. 2 but has, for some installations, an improved rotatable shroud having a double-radiused, arcuate inlet $R_1$ and $R_2$ which is substantially greater than 90°. The leading annular edge 47' of the bell mouth is directed rearwardly and outwardly with respect to recirculation airflow through the shrouding. These refinements provide improved fan operation with further minimized airflow separation.

Figure 4:
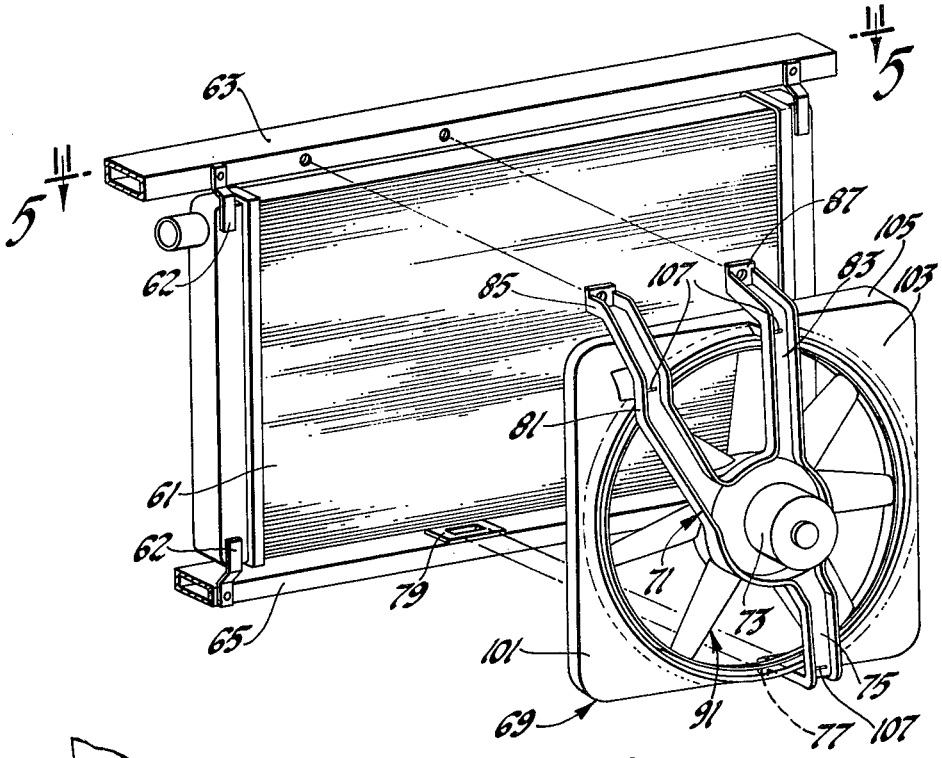
FIG. 4 is an exploded perspective view of an automotive engine cooling radiator, cooling fan and shrouding package embodying a third embodiment of this invention.

In FIG. 4, incorporating another embodiment of the invention, there is shown an engine cooling radiator 61 connected through brackets 62 to elongated upper and lower supports 63 and 65. The radiator is preferably positioned at the front of the vehicle on the outboard side of a transversely mounted internal combustion engine 67 hydraulically connected to the radiator. Disposed behind the radiator 61 is an electric cooling assembly 69 in which a three-armed mounting bracket 71, generally Y-shaped in configuration, provides a central support for an electric motor 73. The lower arm 75 of the bracket 71 has a doglegged end portion 77 that seats in the mounting grommet 79 disposed in a vertical opening in the lower radiator support 65. The bracket 71 has upper arms 81 and 83 having forwardly extending ends 85 and 87 for attachment to the upper radiator support by threaded fasteners 89. The electric motor 73 drives a fan 91, the blades 93 of which are preferably unequally spaced and extend radially from the hub of the fan to a terminal rotating shroud 95. This shroud, corresponding to the rotating shroud of the first embodiment of the invention, has a bell-mouthed inlet section 97 which leads rearwardly into a cylindrical skirt portion 99 that is secured to the tips of the blades 93 of the fan. Disposed about the rotating shroud is a stationary shroud 101 which incorporates a generally rectangular shell-like body 103 having rearwardly extending projections 105 formed thereon which contact the arms of the bracket 71. Stitching wires 107 clinched over on the shroud side of the bracket secure the fixed shroud to the bracket 71 and thus to upper and lower radiator supports. The fixed shroud prevents tail winds from overpowering the fan at idle and causing reduced airflow in the area of the air conditioner heat exchange not shown.

Figure 5:
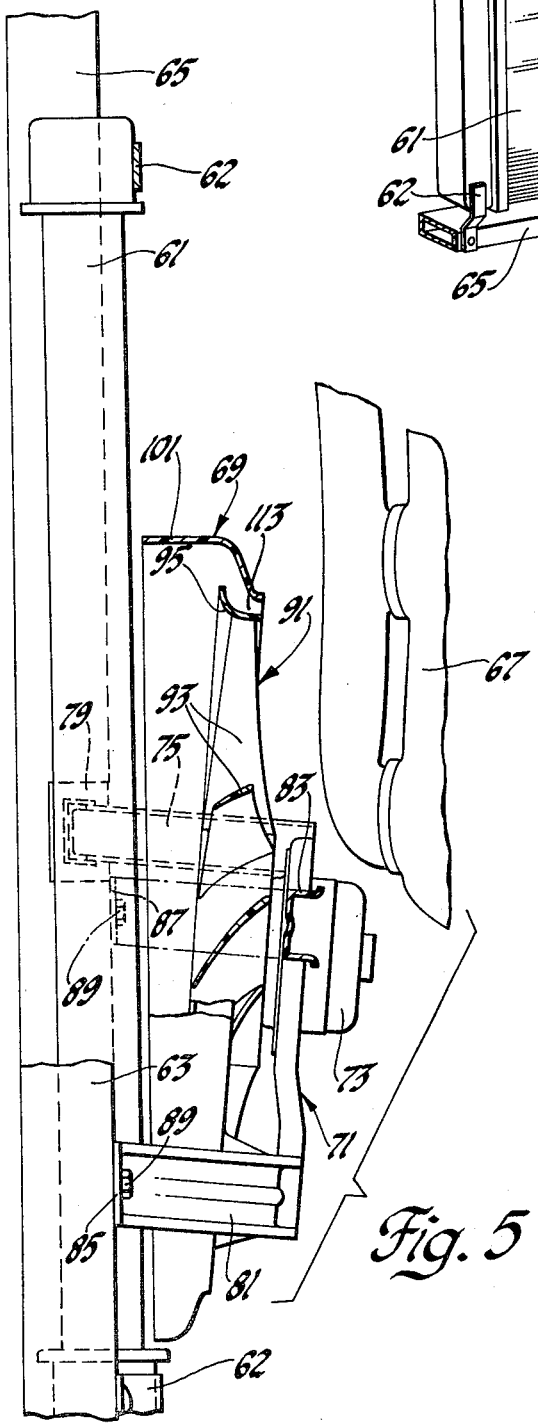
FIG. 5 is a top plan view partly in section of the third embodiment of this invention as viewed along line 5—5 of FIG. 4.
Figure 6:
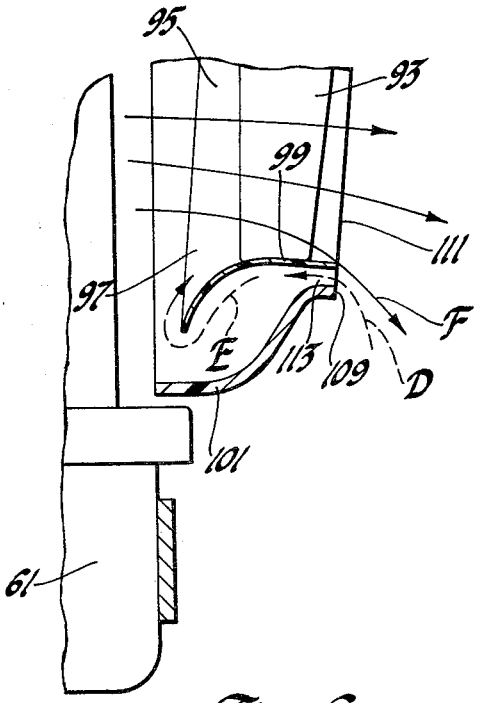
FIG. 6 is an enlarged fragmentary view partly in section of a portion of the radiator and fan shrouding of FIG. 5.

As best shown in FIG. 5, the fan assembly is angulated with respect to the plane of the radiator. With this construction the fan is backed from the face of the radiator and without interference from engine 67 so that the fixed shroud is opened up and is more effective in funneling air through the radiator to the fan for engine cooling purposes. The terminal, annular edge 109 cylindrical ejector portion extends rearwardly from the fixed shroud and has a terminal, annular edge 109 disposed ideally in the same plane as the annular edge 111 of the rotating shroud. However, variations in this alignment occur in view of allowable tolerances and differences in mountings. In any event, the annular clearance 113 between the fixed and rotating shrouds is limited as much as practical. With such limited clearance, the radial component of air pumped by the fan will at least partially block the restricted recirculating air passage 113 with substantially the same beneficial effect as in the embodiments of FIGS. 2 and 3. In FIG. 6, for example, the recirculating airflow illustrated by flow arrows "D" and "E" is reduced by the blockage of passage 113 and the interference from discharge air represented by flow arrow "F."

While a preferred embodiment of the invention has been shown and described to illustrate the invention, other partial fixed shrouding and other modifications will become apparent to those skilled in the art. Accordingly, the scope of this invention is set forth in the following claims.

The embodiments of the invention in which an exclusive property or privilege is claimed are defined as follows:

1. In combination an air-cooled radiator, a rotatable fan spaced rearwardly of said radiator, motor means for rotatably driving said fan, said fan having a plurality of radially extended and arcuately spaced fan blades for pumping an airstream through said radiator, a rotatable shroud secured to the outer tips of said blade including cylindrical skirt section disposed around said fan blades and an annular air inlet section extending radially outwardly from a forward portion of said skirt section through a predetermined arc to a terminal outer annular edge of a diameter greater than the diameter of said skirt section and presenting a smooth inlet surface curved and tapering inwardly so that recirculating air remains attached to the walls of said air inlet section to thereby eliminate unsteady flow interaction characteristics between the recirculating flow of air and the blades of said rotatable fan, a fixed shroud entirely immersing said rotatable shroud therein and secured with respect to said radiator and having an intermediate portion disposed around said rotatable shroud, a cylindrical ejector extending axially from said intermediate portion and disposed radially outwardly of said skirt section of said rotatable shroud to define a restricted recirculation air passage therebetween for the flow of air recirculating from the discharge side of said fan, said ejector extending axially so that a portion of the airstream discharged by said fan will be radially directed to partially block said recirculation air passage and thereby limit the quantity of recirculation air entering said inlet section of said rotating shroud to improve the pumping efficiency of said fan while allowing said fan to operate at a low noise level.

2. In combination, an air-cooled radiator, a rotatable fan spaced rearwardly of said radiator, said fan having a plurality of radially extending spaced fan blades for pumping an airstream through said radiator, motor means operatively connected to said fan for rotatably driving said fan, a rotatable shroud including a cylindrical skirt section secured to the tips of at least some of said fan blades and an annular air inlet section means comprising a flared portion extending radially outwardly from said skirt section thru an arc sufficient to eliminate separation of the boundary layer of air from the inner wall thereof as air discharged by said fan recirculates into said inlet section, a fixed shroud disposed about said fan, said fixed shroud having an intermediate portion surrounding said outwardly flared inlet section and having a generally cylindrical ejector disposed radially outwardly of said skirt section of said rotatable shroud to define a restricted recirculation air passage therebetween for the flow of air recirculating from the discharge side of said fan, said restricted recirculation air passage being partially blocked by a radial component of the airstream discharged by said fan to thereby limit the quantity of recirculation air entering said inlet section of said rotating shroud to improve the pumping efficiency of said fan.

3. In combination, an air-cooled radiator, a rotatable fan spaced rearwardly of said radiator, said fan having a plurality of radially extending spaced fan blades for pumping an air stream through said radiator for the cooling thereof, motor means operatively connected to said fan for rotatably driving said fan, a rotatable shroud secured to the outer tips of said blades including a cylindrical skirt section disposed around said fan blades and an annular bell-mouthed air inlet section flared radially outwardly from said skirt section at an arc of about 90 degrees as a minimum, a fixed shroud circumferentially surrounding said rotatable shroud, fastener means securing said fixed shroud behind said radiator, said fixed shroud having an intermediate portion disposed radially outwardly of said outwardly flared inlet section of said rotatable shroud, said fixed shroud having a cylindrical ejector extending axially from said intermediate portion and throughout its axial dimension disposed at a substantially constant radial distance from said skirt section of said rotatable shroud to thereby define a restricted recirculation air passage therebetween for the flow of air recirculating from the discharge side of said fan, said cylindrical ejector extending axially a predetermined distance beyond said blades of said fan and the end of said skirt section, said ejector having a terminal end with a radius no greater than the other portions of said ejector so that a portion of the air stream discharged by said fan will be radially directed onto the inner wall of said ejector to thereby partially block said recirculation air passage and limit the quantity of recirculation air flowing through said recirculation passage and into said inlet section of said rotating shroud to improve the pumping efficiency of said fan while allowing said fan to operate at a low noise level.

4. A rotatable fan spaced adjacent to a radiator for dissipating heat, said fan having a plurality of radially extending spaced fan blades for pumping an airstream through the radiator, motor means operatively connected to said fan for rotatably driving said fan, a rotatable shroud including a cylindrical skirt section secured to the tips of at least some of said fan blades and an annular air inlet section means comprising a flared portion extending radially outwardly from said skirt section through an arc sufficient to eliminate separation of the boundary layer of air from the inner wall thereof as air discharged by said fan recirculates around said rotatable shroud into said inlet section thereof, a fixed shroud disposed about said fan and in which said rotating shroud is fully immersed, said fixed shroud having an intermediate portion surrounding said outwardly flared inlet section and having an annular ejector disposed radially outwardly of said skirt section of said rotatable shroud to define a restricted recirculation air passage therebetween for the flow of air recirculating from the discharge side of said fan into said inlet section of said rotatable shroud, said ejector and said skirt section having generally coextensive terminal ends disposed closely adjacent to one another, said restricted recirculation air passage being partially blocked by a radial component of the airstream discharged by said fan to thereby limit the quantity of recirculation air entering said inlet section of said rotating shroud to improve the pumping efficiency of said fan.

5. In combination, an air-cooled radiator, a rotatable fan spaced rearwardly of said radiator, said fan having a plurality of radially extending spaced fan blades for pumping an airstream through said radiator, motor means operatively connected to said fan for rotatably driving said fan, a rotatable shroud secured to the outer tips of said blades including a cylindrical skirt section disposed around said fan blades and an annular air inlet section flared radially outwardly from said skirt section at an arc of about 90° as a minimum, a shroud secured to said radiator having an intermediate portion surrounding said outwardly flared inlet section and having a cylindrical ejector extending axially from said intermediate portion and disposed radially outwardly of said skirt section of said rotatable shroud to define a restricted recirculation air passage therebetween for the flow of air recirculating from the discharge side of said fan, said ejector extending axially a predetermined distance beyond said blades to a terminal annular edge substantially coplanar with the end of said skirt section so that a portion of the airstream discharged by said fan will be radially directed towards said ejector to thereby partially block said recirculation air passage and thereby limit the quantity of recirculation air entering said inlet section of said rotating shroud to improve the pumping efficiency of said fan while allowing said fan to operate at a low noise level.

6. In combination, an air-cooled radiator, a rotatable fan spaced rearwardly of said radiator, said fan having a plurality of radially extending spaced fan blades for pumping an airstream through said radiator, motor means operatively connected to said fan for rotatably driving said fan, a rotatable shroud secured to the outer tips of said blades including a cylindrical skirt section disposed around said fan blades and an annular air inlet section flared outwardly from one end of said skirt portion through a predetermined arc and terminating in an outwardly oriented annular edge encircling a portion of said rotating shroud, a fixed shroud secured with respect to said radiator having a large diameter intermediate portion surrounding said outwardly flared inlet section and having a smaller diameter cylindrical ejector extending axially from said intermediate portion and disposed radially outwardly of said skirt section of said rotatable shroud to define a restricted air passage therebetween adapted to conduct flow of air recirculating from the discharge side of said fan into said inlet section, said ejector extending axially to an annular terminal edge generally coextensive with the end of said skirt section so that a portion of the airstream discharged by said fan will be directed radially outwardly from said skirt section to thereby partially pneumatically block said air passage to limit the quantity of recirculation air traversing said air passage and entering said bell-mouthed section of said rotating shroud, resultantly improving the pumping efficiency of said fan while allowing said fan to operate at a low noise level.

7. In combination, an air-cooled radiator, a rotatable fan spaced rearwardly of said radiator, said fan having a plurality of radially extending spaced fan blades for pumping an air stream through said radiator, motor means operatively connected to said fan for rotatably driving said fan, a rotatable shroud secured to the outer tips of said blades including a cylindrical skirt section disposed around said fan blades and an annular bell-mouthed air inlet section flared outwardly from one end of said skirt portion through an arc of at least 90 degrees, said air inlet section terminating in an outwardly oriented annular edge encircling a portion of said rotating shroud, a fixed shroud fastener means securing said fixed shroud downstream of said radiator, said fixed shroud having a large diameter intermediate portion surrounding said outwardly flared inlet section and having a smaller diameter cylindrical ejector extending axially from said intermediate portion and disposed radially outwardly of and at a substantially constant radial distance from said skirt section of said rotatable shroud to define a restricted air passage therebetween adapted to conduct flow of air recirculating from the discharge side of said fan into said inlet section, said ejector extending axially a predetermined distance beyond said blades of said fan and the end of said skirt section to a terminal end with a maximum radius no greater than the other parts of said ejector so that a portion of the air stream discharged by said fan will be directed outwardly and radially towards the end of said ejector to effectively pneumatically block said air passage to thereby limit the quantity of recirculation air traversing said air passage and entering said bell-mouthed section of said rotating shroud, and to improve the pumping efficiency of said fan while allowing said fan to operate at a low noise level.

* * * * *

UNITED STATES PATENT AND TRADEMARK OFFICE

CERTIFICATE OF CORRECTION

PATENT NO. : 4,329,946

DATED : May 18, 1982

INVENTOR(S) : Richard E. Longhouse

It is certified that error appears in the above-identified patent and that said Letters Patent are hereby corrected as shown below:

Column 5, lines 63-64, "The terminal annular edge 109 cylindrical ejector portion" should read -- The cylindrical ejector portion --.

Signed and Sealed this

*Tenth* Day of *August 1982*

[SEAL]

*Attest:*

GERALD J. MOSSINGHOFF

*Attesting Officer*

*Commissioner of Patents and Trademarks*